US006661635B1

(12) United States Patent
Meid

(10) Patent No.: US 6,661,635 B1
(45) Date of Patent: Dec. 9, 2003

(54) ELECTRONIC DRIVE CONTROL APPARATUS

(75) Inventor: Wolfgang Meid, Muelheim-Kaerlich (DE)

(73) Assignee: Moeller GmbH, Bonn (DE)

( * ) Notice: Subject to any disclaimer, the term of this patent is extended or adjusted under 35 U.S.C. 154(b) by 153 days.

(21) Appl. No.: 10/048,111

(22) PCT Filed: Jul. 15, 2000

(86) PCT No.: PCT/EP00/06773

§ 371 (c)(1),
(2), (4) Date: Jan. 25, 2002

(87) PCT Pub. No.: WO01/08188

PCT Pub. Date: Feb. 1, 2001

(30) Foreign Application Priority Data

Jul. 26, 1999 (DE) ..... 199 35 043

(51) Int. Cl.[7] ..... H01H 47/00
(52) U.S. Cl. ..... 361/152; 361/154; 361/172
(58) Field of Search ..... 361/152, 154, 361/158, 172

(56) References Cited

U.S. PATENT DOCUMENTS 4,849,693 A * 7/1989 Prince et al. ..... 324/225
5,065,093 A * 11/1991 Nauta et al. ..... 324/207.12
5,427,451 A * 6/1995 Schmidt ..... 366/208
5,737,172 A 4/1998 Ohtsuka ..... 361/154
6,268,725 B1 * 7/2001 Vernon et al. ..... 324/253

FOREIGN PATENT DOCUMENTS

| | | |
|---|---|---|
| DE | 4117535 | 12/1992 |
| DE | 19641188 | 1/1998 |
| DE | 19711768 | 9/1998 |
| EP | 0789378 | 8/1997 |
| FR | 2696253 | 4/1994 |

* cited by examiner

*Primary Examiner*—Anthony Dinkins
(74) *Attorney, Agent, or Firm*—Davidson, Davidson & Kappel, LLC

(57) ABSTRACT

An electronic drive control used for controlling a drive coil of a contactor during holding operation with a pulse-width modulation. The interval time for the pulse-width modulation is temporally changed or the pulse-width ratio is continuously changed. The invention may minimize the holding power in the case of high voltages without the occurrence of problems associated with EMC and without reducing the functional reliability.

6 Claims, 3 Drawing Sheets

ELECTRONIC DRIVE CONTROL APPARATUS

BACKGROUND

The present invention relates to an apparatus for controlling a drive coil of a contractor in the holding mode.

An electronic drive control for a magnetic drive featuring pulse width modulation of the armature current is known from European Patent Application 0 789 378 A1.

In the case of pulse-width modulated signals, the problem exists that the $T_{ON}$-time cannot be graded, or stepped, with arbitrary fineness. In the holding mode, only 1/7 to 1/12 of the pick-up current is required, which results in the necessity of narrow pulses. In the case of the highest input voltages to be expected, the $T_{ON}$-time must even be considerably shorter, for example, 400 ns. Since only a graduation in finite steps of, for example, 100 ns can be attained, the ratio of the realizable steps to the required pulse duration is relatively high. A shortening of the mentioned shortest $T_{ON}$-time involves EMC problems and requires an outlay which is hardly justifiable any more. In this example, this already corresponds to an increment ratio of 25% and a holding power of 50%. In the case of high voltages, it is therefore not possible for the holding power to be minimized without limiting control, or actuating, reserves. This problem occurs, in particular, in the case of a DC voltage.

SUMMARY OF THE INVENTION

An object of the present invention is to provide an apparatus for controlling the drive coil of a contactor in a holding mode, which allows the holding power to be minimized in a simple manner even in the case of high voltages, without the occurrence of EMC problems and without limitation of the functional reliability.

The present invention provides an apparatus for electronically controlling a drive coil of a contactor in a holding mode using a pulse-width modulation. The apparatus includes an oscillator configured for generating an AC voltage, and a mixer configured for superposing a periodic output signal of the oscillator with an input variable associated with an input voltage so as to generate a pulse-width signal. An interval time for the pulse-width modulation is varied in time or the pulse width ratio is continuously changed.

Using the present invention, not only the holding power is maintained constant in a simple manner even in the case of high voltages but the EMC is improved as well.

BRIEF DESCRIPTION OF THE DRAWINGS

With reference to the drawings, embodiments of the present invention will be described and illustrated in greater detail.

DETAILED DESCRIPTION

Figure 1:
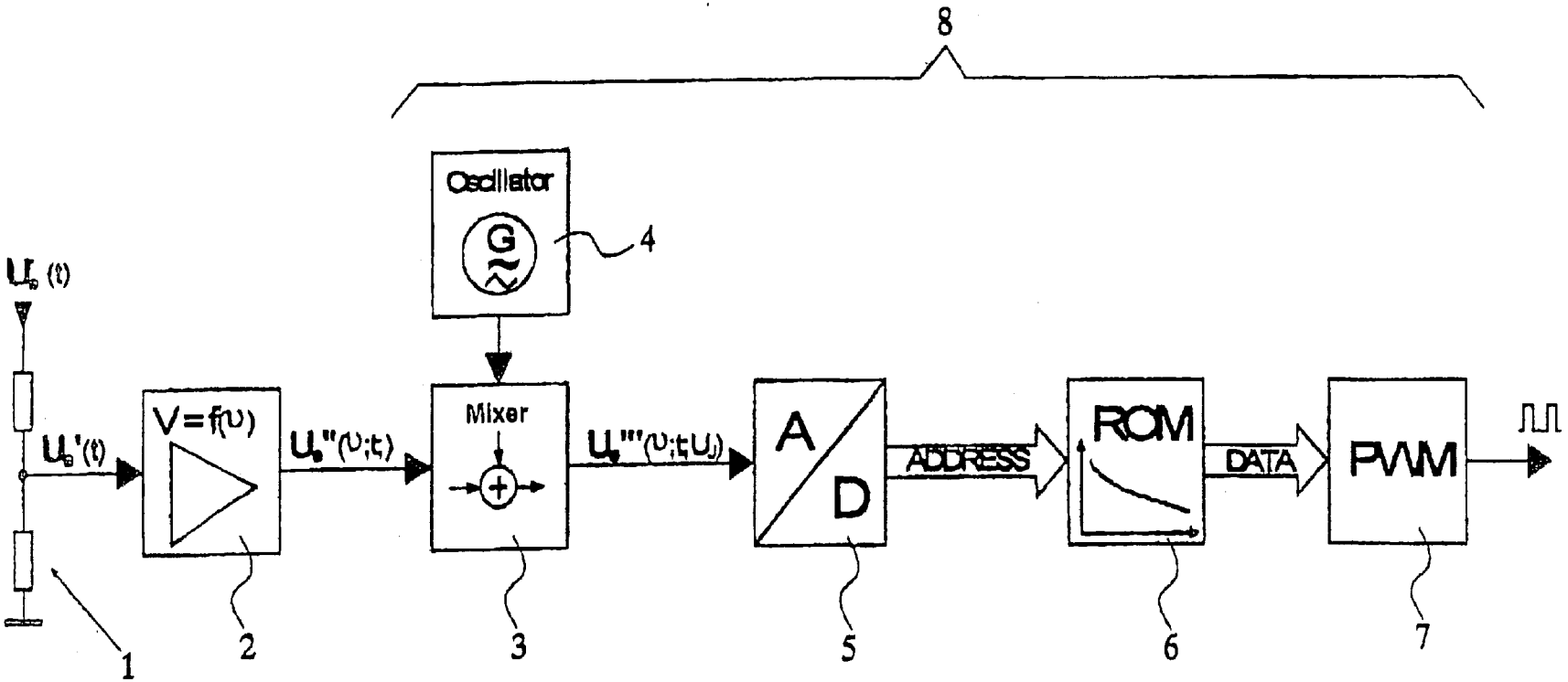
FIG. 1 is a representation of a map-based control.

FIG. 1 shows the control circuit, including a voltage divider 1 and a temperature compensating circuit 2, as well as a control section 8 including a mixer 3, an oscillator 4, an analog-to-digital converter 5, a non-volatile data storage unit 6 and a pulse-width modulator 7 for driving a semiconductor switch which is connected in series with the drive coil. Via mixer 3, an AC voltage is superposed on input voltage $U_e$.

Figure 2:
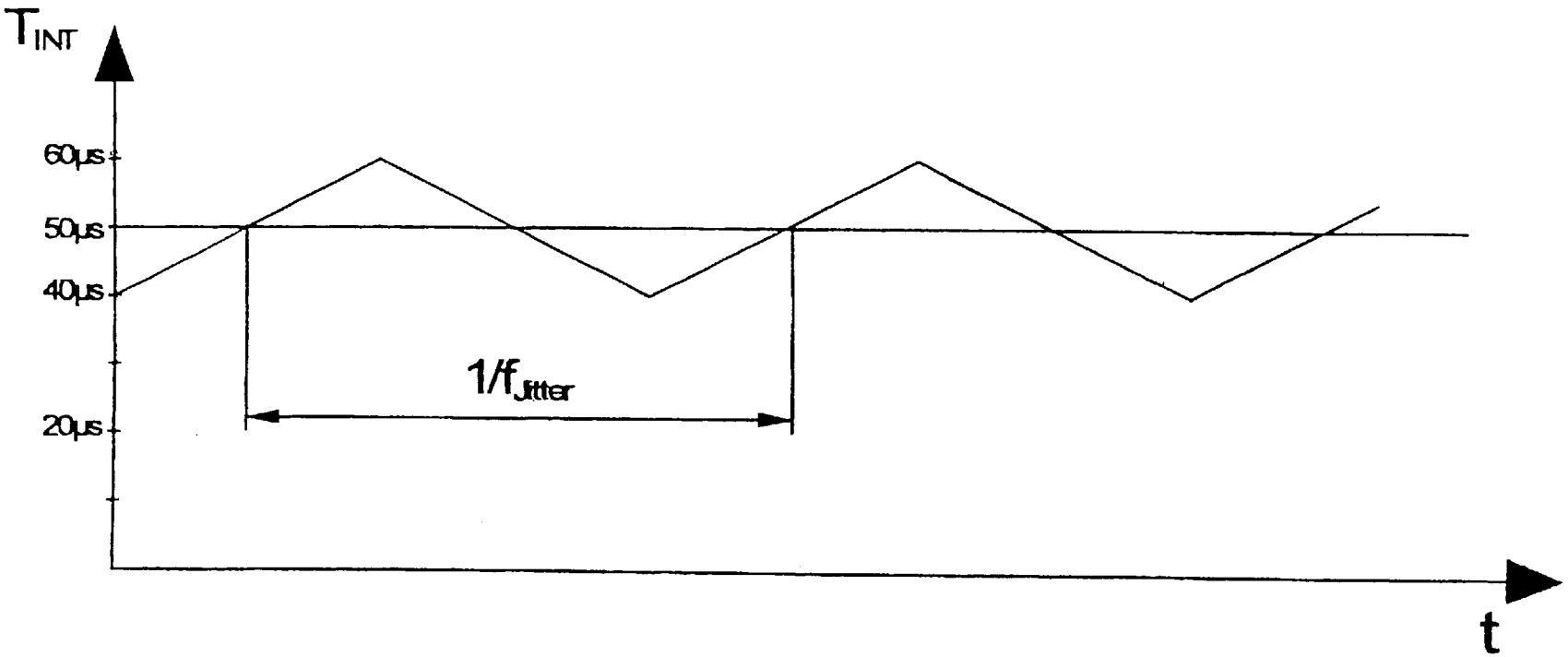
FIG. 2 is a graph representation showing the variation of the interval duration.

FIG. 2 shows the variation of the interval duration over time. The period duration of the curve is $1/f_{Jitter}$, $f_{Jitter}$ being a jitter frequency.

The frequency of the AC voltage is markedly lower than the pulse frequency, preferably 2.5 kHz in AC operation and 8.4 kHz in DC operation. The AC voltage is a triangular or sinusoidal AC voltage.

Due to the superposition of the AC voltage, the voltage fluctuates continuously between two limiting values. This constantly results in new current $T_{ON}$-times. In the process, the positive and negative deviations of the PWM output signal from the ideal $T_{ON}$-time are distributed, and thereby cancel each other out.

Figure 3:
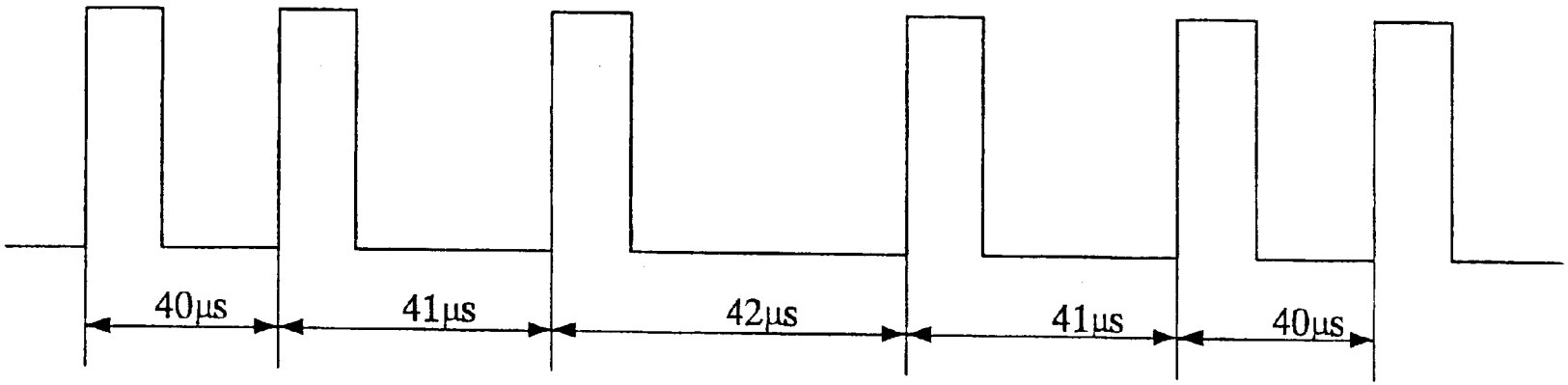
FIG. 3 depicts a pulse timing diagram.

In place of a hardware solution, a software solution is possible, the pulse frequency of the PWM signal continuously being changed by incrementing and decrementing the input for the time interval of the PWM signal via a triangular ramp, as shown in FIG. 3.

Because of the required computing effort, the PWM is determined by a map-based control. In the case of this control, the PWM values are already calculated in the preliminary stages, making allowance for all determinable, constant correction factors, and stored in data storage unit 6 of a microcontroller as a fixed correction table. In this context, the output value of an analog-to-digital converter 5, which is used for measuring the input voltage, serves as an address pointer so that the $T_{ON}$-time or $T_{OFF}$-time appertaining to the so addressed data storage cell can be directly read out therefrom.

Because of noise generation of the magnetic circuit due to the pulsing of the drive coil, unlike the pick-up control during which this short-time noise generation is completely covered by the moving process of the entire drive, it is required for the PWM frequency for the holding mode to be fixed to a frequency which lies outside the human hearing range. In the present case, the PWM signal for the holding mode is fixed to 20 kHz. The current reduction in the holding mode to approximately 1/12 of the pick-up current, the voltage range of approximately 1/4.5 ($U_{Hold(max)}/U_{Hold(min)}$=300V/66V), the peak ratio of √2/1 for the AC operation and the required control reserve of approximately 40% for compensating for the voltage drops at the semiconductors and for compensating for the coil heating, thus result in the shortest required $T_{ON}$-time of approximately 0.4 μs.

To keep the holding current and, consequently, the power loss in the drive coil as low as possible, it is required for the holding current not only to be reduced but also to be maintained constant at as low a value as possible over the entire voltage range because of the large voltage range.

In the case of microcontrollers, the pulse ratio of the PWM modulator cannot be adjusted arbitrarily but rather only as a whole-number multiple of the pulse frequency or of a variable derived therefrom. In the present case, the microcontroller is operated with an oscillator of 10 MHz. The oscillator frequency is internally lowered again to a pulse frequency of 1 MHz by a scaler 10/1 so that a minimum of 1 μs can be adjusted as the shortest $T_{ON}$-time.

Consequently, the shortest $T_{ON}$-time that can be delivered by the microcontroller is longer than the time that is minimally required for the PWM signal so that, for the holding mode, an additional pulse-shaping stage is needed between the PWM output of the microcontroller and the semiconductor switch, the additional pulse-shaping stage allowing the $T_{ON}$-time of the microcontroller to be shortened correspondingly. Furthermore, this pulse-shaping stage which is not further shown is necessary to permit a finer resolution of the $T_{ON}$-time so as to minimize the increment of the holding current and, consequently, of the holding power ($P_{Hold}$~$I_{Hold}^2$).

Via the pulse-shaping stage, it is possible to vary the pulse width from 100 ns to 1 $\mu$s. Via the jittering with the aid of this method, the holding current is maintained constant even in the case of high voltages. Via the jittering, a much higher resolution is attained than by a pure variation of the pulse width. By suitably selecting the jitter frequency, the noise spectrum caused during the switching of the driver transistor can be uniformly distributed, as a result of which noise maxima can be reduced. Thus, the radio interference voltage and electromagnetic emission are reduced.

What is claimed is:

1. An apparatus for electronically controlling a drive coil of a contractor in a holding mode using a pulse-width modulation, comprising:

an oscillator configured for generating an AC voltage; and a mixer configured for superposing a periodic output signal of the oscillator with an input variable associated with an input voltage so as to generate a pulse-width signal;

wherein an interval time for the pulse-width modulation is varied in time or the pulse width ratio is continuously changed.

2. The apparatus as recited in claim 1 further comprising a pulse-width modulator, the pulse-width modulator, the oscillator and the mixer being included in a control section, the control section having a second pulse-width signal as an output variable and having an input variable associated with the input voltage and useable as an input signal.

3. The apparatus as recited in claim 2 further comprising:

a non-volatile data storage unit configured for storing correction factors of pulse-width modulation values as a fixed correction table; and an analog-to-digital converter, an output value of the analog-to-digital converter being provided as an address pointer of the data storage unit;

wherein the non-volatile data storage unit and the analog-to-digital converter are included in the control section, the control section being a map-based control.

4. The circuit arrangement as recited in claim 1 wherein the generated AC voltage has a frequency substantially lower than a pulse-width frequency.

5. The circuit arrangement as recited in claim 4 wherein the frequency of the generated AC voltage is from 1 to 5 kHz in an AC operation.

6. The circuit arrangement as recited in claim 4 wherein the frequency of the generated AC voltage is from 5 to 15 kHz in a DC operation.

* * * * *